US010816269B2

(12) United States Patent
Hietbrink et al.

(10) Patent No.: US 10,816,269 B2
(45) Date of Patent: Oct. 27, 2020

(54) ASSEMBLY COMPRISING AN OBJECT HAVING A SURFACE WHICH IS INTENDED TO BE EXPOSED TO WATER AND AN ANTI-FOULING PROTECTOR ARRANGEMENT

(71) Applicant: KONINKLIJKE PHILIPS N.V., Eindhoven (NL)

(72) Inventors: Roelant Boudewijn Hietbrink, Eindhoven (NL); Bart Andre Salters, Eindhoven (NL); Johannes Antonius Kroeze, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 233 days.

(21) Appl. No.: 15/570,762

(22) PCT Filed: Apr. 26, 2016

(86) PCT No.: PCT/EP2016/059328

§ 371 (c)(1),
(2) Date: Oct. 31, 2017

(87) PCT Pub. No.: WO2016/177608

PCT Pub. Date: Nov. 10, 2016

(65) Prior Publication Data

US 2018/0120031 A1 May 3, 2018

(30) Foreign Application Priority Data

May 6, 2015 (EP) ..... 15166549

(51) Int. Cl.
*B60H 3/00* (2006.01)
*F28D 1/02* (2006.01)
(Continued)

(52) U.S. Cl.
CPC ..... *F28D 1/022* (2013.01); *F28D 1/0475* (2013.01); *F28F 19/00* (2013.01); *F28F 2265/20* (2013.01)

(58) Field of Classification Search
CPC ..... F28D 1/0475; F28F 19/00; F28F 2265/20
(Continued)

(56) References Cited

U.S. PATENT DOCUMENTS 3,634,025 A * 1/1972 Landry ..... A61L 2/10 250/436
4,474,228 A * 10/1984 Rogalski ..... B63G 8/36 165/104.14

(Continued)

FOREIGN PATENT DOCUMENTS

AU 200222997 B2 9/2003
DE 102008029464 A1 1/2010

(Continued)

*Primary Examiner* — Claire E Rojohn, III

(57) ABSTRACT

An assembly comprises an object (2, 101, 102, 103) having a surface which is intended to be exposed to water during at least a part of the lifetime thereof. In order to be capable of avoiding biofouling of the surface in a first stage of the lifetime of the assembly, without needing to have a supply of power in order to achieve the anti-fouling effect as desired in that first stage, the assembly furthermore comprises an anti-fouling protector arrangement (30) which is adapted to initially prevent the surface from being contacted by water, and which comprises degradable material. Also, the assembly comprises at least one energy source (20) which is adapted to emit energy for causing the protector arrangement (30) to disintegrate.

17 Claims, 4 Drawing Sheets

(51) Int. Cl.
*F28F 19/00* (2006.01)
*F28D 1/047* (2006.01)

(58) Field of Classification Search
USPC ..... 165/44
See application file for complete search history.

(56) References Cited

U.S. PATENT DOCUMENTS 4,482,809 A * 11/1984 Maarschalkerweerd ..... A61L 2/10 250/436
4,778,653 A * 10/1988 Kamimura ..... B08B 17/00 210/764
4,840,226 A * 6/1989 Richlen ..... F28F 19/00 165/134.1
4,990,313 A * 2/1991 Pacosz ..... F24F 3/166 422/121
5,019,256 A * 5/1991 Ifill ..... B01J 19/123 210/192
5,308,505 A * 5/1994 Titus ..... A61L 2/0011 210/745
5,322,569 A * 6/1994 Titus ..... A61L 2/0011 134/1
5,334,347 A * 8/1994 Hollander ..... A61L 9/20 250/455.11
6,182,461 B1 * 2/2001 Washburn ..... A61L 9/205 62/264
6,245,293 B1 * 6/2001 Fencl ..... A61L 2/10 134/1
6,267,924 B1 * 7/2001 Fencl ..... A61L 2/10 165/95
6,550,257 B1 * 4/2003 Goetzinger ..... F24F 3/166 62/291
6,579,495 B1 * 6/2003 Maiden ..... C02F 1/325 210/748.11
9,647,771 B2 * 5/2017 Neuner, III ..... H04B 10/80
9,735,891 B1 * 8/2017 Neuner, III ..... H04B 10/80
9,816,055 B2 * 11/2017 Leatham ..... C11D 3/3945
10,252,783 B2 * 4/2019 Salters ..... B08B 17/02
10,407,141 B2 * 9/2019 Hietbrink ..... B63B 13/00
10,436,437 B1 * 10/2019 Usher ..... B08B 7/0057
10,517,972 B2 * 12/2019 Usher ..... A61L 2/08
2006/0266042 A1 * 11/2006 Levine ..... F28D 1/022 60/645
2007/0144893 A1 * 6/2007 Van Boxtel ..... C23F 13/10 204/196.01
2012/0318474 A1 * 12/2012 Lieskoski ..... F28F 9/0132 165/45
2013/0048877 A1 * 2/2013 Thoren ..... B08B 17/02 250/492.1
2013/0283768 A1 * 10/2013 Sputh ..... B63H 21/32 60/274
2014/0138093 A1 * 5/2014 Moore ..... E21B 36/001 166/302
2014/0196745 A1 * 7/2014 Whelan ..... B08B 17/02 134/1
2015/0354321 A1 * 12/2015 Urbanski ..... E21B 36/001 165/45
2016/0222761 A1 * 8/2016 Cain ..... E21B 36/001
2016/0237800 A1 * 8/2016 Friedemann ..... E21B 36/001
2016/0341481 A1 * 11/2016 Freund ..... F28F 1/126
2017/0044968 A1 * 2/2017 Kimball ..... F28D 1/022
2017/0197693 A1 * 7/2017 Salters ..... B63B 59/04
2018/0106131 A1 * 4/2018 Kanstad ..... E21B 43/017
2018/0120031 A1 * 5/2018 Hietbrink ..... F28F 19/00
2018/0179945 A1 * 6/2018 Salters ..... B63B 59/04
2018/0356163 A1 * 12/2018 Schechner ..... F28D 1/0408

FOREIGN PATENT DOCUMENTS

DE 102010052446 A1 2/2012
EP 1233159 A1 8/2002
JP 2012162252 A * 8/2012
JP 2012162252 A 8/2012
WO 0078605 A1 12/2000
WO 2014113182 A1 7/2014
WO 2014188347 A1 11/2014
WO 2015040096 A1 3/2015

* cited by examiner

ASSEMBLY COMPRISING AN OBJECT HAVING A SURFACE WHICH IS INTENDED TO BE EXPOSED TO WATER AND AN ANTI-FOULING PROTECTOR ARRANGEMENT

CROSS-REFERENCE TO PRIOR APPLICATIONS

This application is the U.S. National Phase application under 35 U.S.C. § 371 of International Application No. PCT/EP2016/059328, filed on 26 Apr. 2016, which claims the benefit of European Patent Application No. 15166549.4, filed on 6 May 2015. These applications are hereby incorporated by reference herein.

FIELD OF THE INVENTION

The invention relates to an assembly comprising an object having a surface which is intended to be exposed to water during at least a part of the lifetime thereof. An example of an application of such an assembly is in an engine-driven ship in view of the fact that such a ship may be equipped with a box cooler for cooling the fluid of an engine cooling system of the ship, the box cooler comprising a plurality of tubes for containing and transporting the fluid to be cooled in their interior. Typically, such a ship has a compartment for accommodating the tubes of the box cooler, wherein the compartment is defined by a portion of the hull of the ship and partition plates, and wherein entry and exit openings are arranged in the hull at the position of the compartment so that seawater can enter the compartment, flow over the tubes in the compartment, and exit the compartment through natural flow and/or under the influence of motion of the ship. Hence, in such a case, the object having the surface to be exposed to water during at least a part of the lifetime thereof is an exterior surface of the entirety of the tubes of the box cooler.

Furthermore, the invention relates to a method for temporarily preventing exposure of a surface of an object to water in a first stage and allowing such exposure in a subsequent second stage.

BACKGROUND OF THE INVENTION

A box cooler is a specific type of heat exchanger which is designed for use in an engine-driven ship. For example, in the case of a tugboat having an installed engine power of 15 MW, one or more box coolers are applied for transferring heat in the order of 5 MW to the seawater. Usually, a box cooler comprises bundles of U-shaped tubes for conducting a fluid to be cooled, wherein ends of leg portions of the tubes are secured to a common plate having openings for providing access to both leg portions of each of the tubes. It is a very practical option to enable the box cooler to perform its cooling function by continuously exposing the tubes thereof to fresh water from the immediate outside environment of the ship. However, the environment of a box cooler is ideally suited for a phenomenon known as biofouling or biological fouling, as the water is heated to a medium temperature in the vicinity of the tubes as a result of the heat exchange with the relatively hot fluid in the interior of the tubes, and the constant flow of water continuously brings in new nutrients and organisms which are known to cause biofouling.

In general, biofouling is the accumulation of microorganisms, plants, algae, small animals and the like on surfaces. According to some estimates, over 1,800 species comprising over 4,000 organisms are responsible for biofouling. Hence, biofouling is caused by a wide variety of organisms, and involves much more than an attachment of barnacles and seaweeds to surfaces. Biofouling is divided into micro fouling which includes biofilm formation and bacterial adhesion, and macro fouling which includes the attachment of larger organisms. Due to the distinct chemistry and biology that determine what prevents them from settling, organisms are also classified as being hard or soft. Hard fouling organisms include calcareous organisms such as barnacles, encrusting bryozoans, mollusks, polychaetes and other tube worms, and zebra mussels. Soft fouling organisms include non-calcareous organisms such as seaweed, hydroids, algae and biofilm "slime". Together, these organisms form a fouling community.

In several situations, bio fouling creates substantial problems. Bio fouling can cause machinery to stop working, water inlets to get clogged, and heat exchangers to suffer from reduced performance. Hence, the topic of anti-fouling, i.e. the process of removing or preventing bio fouling, is well-known. In industrial processes involving wetted surfaces, bio dispersants can be used to control biofouling. In less controlled environments, fouling organisms are killed or repelled with coatings using biocides, thermal treatments or pulses of energy. Nontoxic mechanical strategies that prevent organisms from attaching to a surface include choosing a material or coating for causing the surface to be slippery, or creating nanoscale surface topologies similar to the skin of sharks and dolphins which only offer poor anchor points.

Biofouling of box coolers causes severe problems. The main issue is a reduced heat transferring capability as layers of biofouling are effective heat insulators. When the bio fouling layers are so thick that water can no longer circulate between adjacent tubes of the box cooler, an additional deteriorating effect on the heat transfer is obtained. Thus, bio fouling of box coolers increases the risk of engine overheating, so that ships need to slow down or ship engines get damaged.

Anti-fouling arrangements for cooling units that cool the water from a cooling water system of an engine-driven ship by means of seawater are known in the art. For example, DE 102008029464 relates to a box cooler for use in ships and on offshore platforms, comprising an integrated anti-fouling system for killing fouling organisms by means of an overheating process that can be regularly repeated. In particular, the box cooler is protected against microorganism fouling by continuously overheating a defined number of heat exchanger tubes without interrupting the cooling process, wherein waste heat from the cooling water may be used for doing so.

A problem associated with the known anti-fouling arrangement is that the anti-fouling effect as desired can only be obtained when the box cooler is operated. Therefore, the anti-fouling arrangement is not suitable for preventing biofouling in case the box cooler is newly installed in a ship, and the ship is not yet put into operation. A number of ship builders deal with such a case, because they build ships before actually selling the ships, so as to create a stock with ships. Usually, the ships to be sold are stored floating on the water during quite some time. The ships may be equipped with a number of box coolers, wherein the number may amount to eight, or even twelve, for example, all of which foul if no measures are taken besides installing the anti-fouling arrangement that requires operation of the box cooler in order to be functional. Hence, in the conventional situation, the tubes of the box coolers of a ship that has been stored for some time need to be cleaned before delivery of the ship to a customer. In some cases, this problem is solved by keeping a so-called ICAF system active throughout the inactive period of the ship, wherein ICAF stands for Impressed Current Anti-Fouling. However, such solution introduces a new problem, due to the fact that copper pollution is involved in operation of an ICAF system. Another new problem is the fact that operation of an ICAF system involves power consumption.

SUMMARY OF THE INVENTION

It is an object of the invention to provide a practical way of preventing bio fouling of the tubes of a box cooler during the period prior to the moment of initial operation of the ship in which the box cooler is installed, without needing to apply an active system for achieving anti-fouling, i.e. a system which requires supply of power in order to be able to operate and perform its anti-fouling function. In general, it is an object of the invention to provide a practical way of preventing bio fouling of a surface of an object, which surface is intended to be exposed to water during at least a part of the lifetime of the object, during a period that a larger device of which the object is part is not in operation, without needing to apply an active system.

As mentioned in the foregoing, the invention relates to an assembly comprising an object having a surface which is intended to be exposed to water during at least a part of the lifetime thereof. According to the invention, in order to achieve the object of the invention, the assembly furthermore comprises an anti-fouling protector arrangement which is arranged to initially prevent the surface of the object from being contacted by water, and which comprises degradable material, and at least one energy source which is adapted to emit energy for causing the protector arrangement to disintegrate. In respect of the degradable material of the anti-fouling protector arrangement, it is noted that this may be a polymer in a practical embodiment of the assembly according to the invention.

The invention provides a solution to the problem of bio fouling of a surface of an object taking place even when an anti-fouling arrangement is provided with the surface, namely when the anti-fouling arrangement is not in operation for a considerable amount of time. In particular, the solution is based on providing removable watertight protection of the surface, and involves a use of degradable material. Hence, when the invention is applied, exposure of the surface to water can be prevented as long as it is desirable to do so during a first stage, and exposure of the surface to water can be enabled as soon as it is practical to do so during a subsequent second stage, wherein the transition from the first stage to the second stage is related to disintegration of material. In any case, during the period that exposure of the surface to water is prevented, bio fouling of the surface cannot take place on the basis of the presence of the protector arrangement.

The protector arrangement may be adapted to enclose the surface in a watertight fashion. For example, the protector arrangement may comprise a piece of foil which is arranged so as to enwrap the object in a watertight fashion. In such a case, especially when the invention is applied in the context of ships and box coolers, it is advantageous for at least a part of the piece of foil to be degradable under the influence of a particular type of energy, based on the insight that a use of energy such as ultraviolet light may already be foreseen for the purpose of anti-fouling during operation of the assembly according to the invention. In a general sense, the assembly according to the invention comprises at least one energy source which is adapted to emit energy for causing the protector arrangement to disintegrate, wherein the invention involves a use of material in the protector arrangement that is degradable under the influence of energy emitted by the energy source during operation thereof. In this respect, it is preferred if the energy source is not only suitable to be used for terminating the waterproof protective function of the protector arrangement, but is also suitable to be used in another way such as for realizing active anti-fouling of the surface, i.e. anti-fouling on the basis of a supply of power, which may be electrical power. In that advantageous case, the energy source has a primary function in preventing bio fouling of the surface, and the energy source has a secondary function in causing the protector arrangement to disintegrate.

As mentioned in the foregoing, the assembly according to the invention comprises at least one energy source for producing energy which is intended to be used for causing the protector arrangement to disintegrate, and possibly also for anti-fouling purposes after disintegration of the protector arrangement. For example, the arrangement may comprise a plurality of ultraviolet light sources having a generally elongated shape, which does not alter the fact that other embodiments of the at least one energy source are feasible as well. In case ultraviolet light is used for achieving an anti-fouling effect after disintegration of the protector arrangement, in order to enhance distribution of the ultraviolet light over the surface to be kept clean, the surface may be at least partially coated with an ultraviolet light reflective coating, and the same may be applicable for surfaces in the immediate environment of the surface. In any case, by having a combination of an energy source for producing energy during operation thereof and a protector arrangement comprising material that is degradable under the influence of the energy, it is achieved that the protector arrangement is intact as long as the energy source is not activated, and that disintegration of the protector arrangement is realized at initial activation of the energy source.

It follows from the foregoing that in the situation of a ship being on the water prior to being put to operation, it is very well possible to prevent fouling of the tubes of the box cooler(s) of the ship both during the period prior to the maiden voyage of the ship and the period after the ship has been sent off on its maiden voyage, wherein during the first period, anti-fouling does not require a supply of power, being based on having a physical barrier between the tubes of the box cooler(s) and the water, and wherein during the second period, anti-fouling is realized by exposing the tubes as continuously contacted by the water to ultraviolet light or another suitable type of energy such as thermal energy. Advantageously, there is no need for having additional means for removing the physical barrier at the appropriate moment, as the energy emitted by at least one energy source can be used for doing so in view of the fact that the initial watertight protection of the tubes of the box cooler(s) can be at least partially degradable under the influence of energy.

In case an energy source is applied which has a primary function in preventing bio fouling of the surface of the object which is initially prevented by the protector arrangement from being contacted by water, in order to guarantee an effective change of the protector assembly to a condition for allowing water to reach the surface, it may be practical if the assembly according to the invention comprises controlling means for temporarily operating the energy source at a power level which is significantly higher than a power level associated with normal operation of the energy source for performing its primary anti-fouling function, after the very first activation of the energy source.

In respect of the possibility of the anti-fouling protector arrangement comprising a piece of foil, as mentioned earlier, it is noted that the piece of foil may be entirely made of the material that is degradable under the influence of energy emitted by the energy source during operation thereof, but that this is not necessary within the framework of the invention. In fact, it is also possible for the piece of foil to comprise parts which are entirely made of the material that is degradable under the influence of the energy, and parts which are made of material that remains intact under the influence of the energy. In such a case, it is possible to realize that when the energy source is activated to produce the energy, the foil falls down in pieces in a controlled way. It is advantageous if the foil parts which are entirely made of the material that is degradable under the influence of the energy are thinner than the foil parts which are made of the material that remains intact under the influence of the energy, so that disintegrating the first foil parts requires only minimal time and power, while the foil can be relatively strong at the areas where the latter foil parts are present, as a result of which the chance of the foil getting damaged and thereby losing its watertight properties can be kept to a minimum.

Besides parts which are entirely made of the material that is degradable under the influence of the energy emitted by the energy source during operation thereof, as mentioned, the piece of foil may comprise parts which are made of water soluble material covered with the material that is degradable under the influence of the energy. In such a case, when the foil is exposed to the energy, it happens that the first parts disintegrate, and that disintegration of the latter parts takes place as well, until only the water soluble material remains. Assuming that the foil is contacted by water, the water soluble material dissolves, so that eventually, it is achieved that the entire foil is gone. An advantage of using water soluble material is that a supply of power is not required for making the material disappear. Also in this case of having water soluble material in the foil, it may be advantageous if the foil parts which are entirely made of the material that is degradable under the influence of the energy are thinner than the foil parts which are made of the water soluble material covered with the material that is degradable under the influence of the energy.

According to a feasible option existing within the framework of the invention, the assembly comprises a compartment which is provided with at least one entry opening for allowing water to enter the compartment, wherein the surface of the object which is initially prevented by the protector arrangement from being contacted by water is situated in the compartment. The assembly may furthermore comprise a functional unit that is arranged in the compartment and that is intended to be exposed to water during operation thereof, wherein the surface of the object which is initially prevented by the protector arrangement from being contacted by water comprises an exterior surface of the functional unit. When the protector arrangement comprises a piece of foil being at least partially made of degradable material, the piece of foil may be arranged so as to enwrap the functional unit in the compartment in a watertight fashion.

Assuming that the assembly comprises a compartment as mentioned in the preceding paragraph, it is practical for the assembly to comprise a water sensor which is situated in the compartment, and means for activating the at least one energy source of the assembly when water is detected by the water sensor, so that in case it appears that the protector arrangement fails to be watertight while the energy source is in an inactive condition, the energy source may automatically be switched on in order to avoid fouling of the surface of the object which is initially prevented by the protector arrangement from being contacted by water. Additionally or alternatively, measures may be taken for ensuring that a warning signal such as a sound signal is issued in the situation in which the energy source is activated on the basis of the detection of water in the compartment.

As mentioned in the foregoing, a practical example of a functional unit as may be used in the assembly according to the invention is an entirety of tubes of a box cooler, which is normally situated in a compartment of a vessel such as a ship. In general, it is possible for the functional unit to comprise an entirety of tubes which are part of a cooling apparatus, and which serve for containing and transporting fluid to be cooled in their interior. When at least one energy source which is adapted to produce ultraviolet light is used in the assembly according to the invention, it is practical if a plurality of ultraviolet light sources are applied and arranged in an area where the tubes are present. As is known from the field of box coolers, at least a part of the cooling apparatus may have a layered structure in which the tubes are arranged in tube layers, each tube layer including at least one tube. In particular, the tube layers may include a number of U-shaped tubes having a curved bottom portion and two substantially straight leg portions, wherein the tubes of a tube layer have mutually different sizes, ranging from a smallest tube to a largest tube, the smallest tube having a smallest radius of the bottom portion, and the largest tube having a largest radius of the bottom portion, wherein top sides of the leg portions of the tubes are at a similar level in the cooling apparatus, and wherein the leg portions of the tubes extend substantially parallel to each other.

For the sake of completeness, the following is noted in respect of anti-fouling by using ultraviolet light. Anti-fouling means which are adapted to produce ultraviolet light may comprise light sources which are chosen to specifically emit ultraviolet light of the c type, which is also known as UVC light, and even more specifically, light with a wavelength roughly between 250 nm and 300 nm. It has been found that most fouling organisms are killed, rendered inactive, or rendered unable to reproduce by exposing them to a certain dose of the ultraviolet light. A typical intensity which appears to be suitable for realizing anti-fouling is 10 mW per square meter, to be applied continuously or at a suitable frequency. A very efficient source for producing UVC light is a low pressure mercury discharge lamp, in which an average of 35% of input power is converted to UVC power. Another useful type of lamp is a medium pressure mercury discharge lamp. The lamp may be equipped with an envelope of special glass for filtering out ozone-forming radiation. Furthermore, a dimmer may be used with the lamp if so desired. Other types of useful UVC lamps are dielectric barrier discharge lamps, which are known for providing very powerful ultraviolet light at various wavelengths and at high electrical-to-optical power efficiencies, and LEDs. In respect of the LEDs, it is noted that they can generally be included in relatively small packages and consume less power than other types of light sources. LEDs can be manufactured to emit (ultraviolet) light of various desired wavelengths, and their operating parameters, most notably the output power, can be controlled to a high degree.

The light sources for emitting ultraviolet light can be provided in the form of a tubular lamp, more or less comparable to a well-known TL (tube luminescent/fluorescent) lamp. For various known germicidal tubular UVC lamps, the electrical and mechanical properties are comparable to those properties of tubular lamps for producing visible light. This allows the UVC lamps to be operated in the same way as the well-known lamps, wherein an electronic or magnetic ballast/starter circuit may be used, for example.

A general advantage of using ultraviolet light for realizing anti-fouling is that the microorganisms are prevented from adhering and rooting on the surface of the functional unit to be kept clean. Contrariwise, when known poison dispersing coatings are applied, the anti-fouling effect is achieved by killing the microorganisms after they have adhered and rooted on the surface. Prevention of bio fouling by means of light treatment is preferred over removal of biofouling by means of light treatment, as the latter requires more input power and involves a higher risk that the light treatment is not sufficiently effective. In view of the fact that the light sources for producing ultraviolet light may be arranged and configured such that only a relatively low level of input power is needed, the light sources may be operated to continuously produce anti-fouling light across a large surface without extreme power requirements, or the light sources may be operated at a duty cycle, wherein the light sources are on for a certain percentage of a time interval, and off for the rest of the time interval, wherein the time interval may be chosen to be in the order of magnitude of minutes, hours, or whatever is appropriate in a given situation. As not much additional power is required, the light sources can be easily applied in existing structures.

In an aspect, the invention relates to a method for temporarily preventing exposure of a surface of an object to water in a first stage and allowing such exposure in a subsequent second stage. In conformity with what has already been explained in the foregoing, the method may involve providing an anti-fouling protector arrangement comprising degradable material and an energy source for emitting energy for disintegrating the material of the protector arrangement, wherein the protector arrangement is arranged so as to prevent the surface of the object from being contacted by water, and wherein the energy source is kept deactivated in the first stage and is only activated in the second stage. Advantageously, the energy source is not only used for removing the protector arrangement by causing at least a part of the protector arrangement to disintegrate, but also for realizing anti-fouling of the surface during the second stage, which may last as long as the rest of the lifetime of the surface. Hence, it is possible for the method according to the invention to comprise a step of keeping the energy source activated in the second stage also after disintegration of the material of the protector arrangement in order to prevent bio fouling of the surface of the object under the influence of energy emitted by the energy source during operation thereof. In this respect, it is noted once again that it is possible to adapt the power level at which the energy source is operated to the function to be performed, wherein the power level is set such as to be higher in the situation in which disintegration of the protector arrangement is to be realized, and lower in the situation in which the energy is only needed for achieving anti-fouling effects. Thus, it may be so that in the second stage, the energy source is initially operated at a power level which is significantly higher than a power level of operation of the energy source during the rest of the second stage. That does not alter the fact that it is also possible to have at least one energy source just for realizing the disintegration of the protector arrangement, and to have at least one other energy source just for preventing fouling of the surface which is no longer prevented from being contacted by water once the protector arrangement has been removed, and possibly also one or more other surfaces.

The above-described and other aspects of the invention will be apparent from and elucidated with reference to the following detailed description of a box cooler comprising a plurality of tubes for containing and transporting the fluid to be cooled in their interior, a plurality of light sources for casting anti-fouling light on the tubes, a compartment of a ship accommodating the tubes of the box cooler and the light sources, and measures for protecting the tubes from being contacted by water during a first stage, and for allowing water to contact the tubes during a subsequent second stage, which involve a use of a degradable foil.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
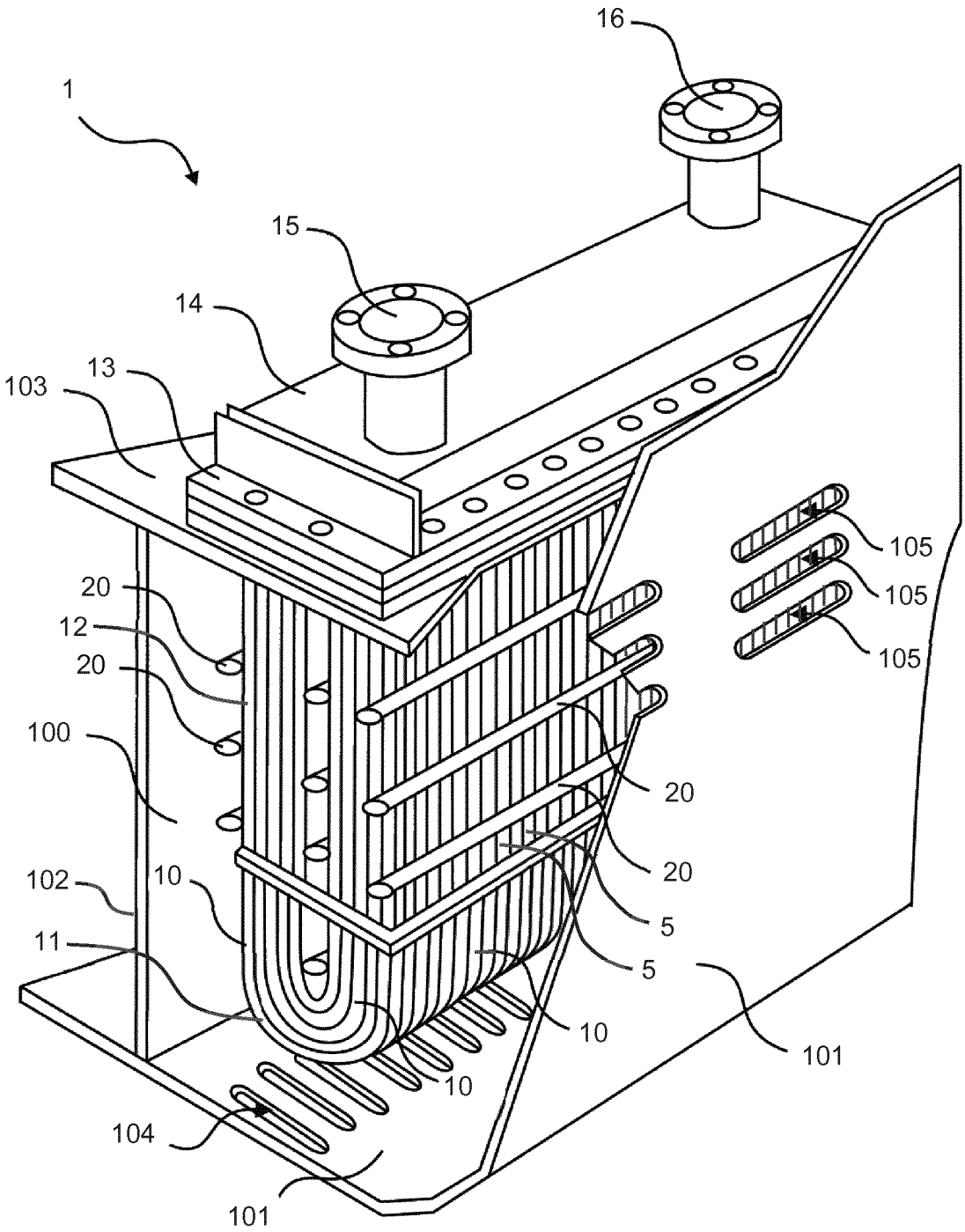
FIG. 1 diagrammatically shows a perspective view of a box cooler and a portion of walls delimiting a compartment of a ship in which an entirety of tubes of the box cooler is arranged, and furthermore shows a number of lamps for casting anti-fouling light over the exterior of the tubes of the box cooler.

FIG. 1 shows a box cooler 1, which comprises a plurality of tubes 10 for containing and transporting a fluid to be cooled in their interior. The box cooler 1 is intended to be used in an engine-driven ship, wherein the fluid to be cooled is fluid from an engine cooling system of the ship, and wherein the box cooler 1 is enabled to perform its function of cooling the fluid by exposing the tubes 10 of the box cooler 1 to water from the immediate outside environment of the ship, which will hereinafter be referred to as seawater. In particular, the tubes 10 of the box cooler 1 are accommodated inside a compartment 100 of the ship, the compartment 100 being delimited by a portion of the ship's hull 101 and a number of partition plates 102, 103. In the ship's hull 101, a number of entry openings 104 are arranged for allowing seawater to enter the compartment 100 from the outside, and a number of exit openings 105 are arranged in the ship's hull 101 as well, for allowing seawater to exit the compartment 100 and to flow to the outside of the ship. Typically, the entry openings 104 and the exit openings 105 are arranged at different levels, wherein the level of the entry openings 104 is lower than the level of the exit openings 105, assuming a normal, upright orientation of the ship, the compartment 100 and the box cooler 1 in conformity with FIG. 1. For the sake of completeness, it is noted that indications of directions, both explicit and implicit, as used in the following description are to be understood such as to have the normal, upright orientation of the ship, the compartment 100 and the box cooler 1 as mentioned as underlying assumption.

The tubes 10 of the box cooler 1 have a curved shape, particularly a U shape, comprising a curved bottom portion 11 and two substantially straight leg portions 12 extending substantially parallel to each other, in an upward direction with respect to the bottom portion 11. During operation of the box cooler 1, fluid to be cooled, i.e. hot fluid, flows through the tubes 10, while seawater enters the compartment 100 through the entry openings 104. On the basis of the interaction of the seawater with the tubes 10 containing the hot fluid, it happens that the tubes 10 and the fluid are cooled, and that the seawater heats up. On the basis of the latter effect, a natural flow of rising seawater is obtained in the compartment 100, wherein cold seawater enters the compartment 100 through the entry openings 104, and wherein seawater at a higher temperature exits the compartment 100 through the exit openings 105. Also, motion of the ship may contribute to the flow of seawater through the compartment 100. Advantageously, the tubes 10 are made of a material having good heat transferring capabilities, such as copper.

The tubes 10 of the box cooler 1 are arranged in similar, substantially parallel tube layers 5, each of those tube layers 5 comprising a number of tubes 10 of different size arranged in a bundle, wherein a smaller tube 10 is arranged inside of the curved shape of a larger tube 10, so as to be encompassed by a larger tube 10 at a certain distance for leaving space between the tubes 10 in the tube layer 5 where seawater can flow. Hence, each tube layer comprises a number of hairpin-type tubes 10 comprising two straight leg portions 12 and one curved portion 11. The tubes 10 are disposed with their curved portions 11 in substantially concentric arrangement and their leg portions 12 in substantially parallel arrangement, so that the innermost curved portions 11 are of relatively small radius of curvature and the outermost curved portions 11 are of relatively large radius of curvature, with at least one remaining intermediate curved portion 11 disposed therebetween. In case there are at least two intermediate curved portions 11, those portions 11 are of progressively graduated radius of curvature.

Top sides of the leg portions 12 of the tubes 10 are at a similar level in view of the fact that the top sides of the leg portions 12 of the tubes 10 are connected to a common tube plate 13. The tube plate 13 is covered by a fluid header 14 comprising at least one inlet stub 15 and at least one outlet stub 16 for the entry and the exit of fluid to and from the tubes 10, respectively. Hence, the leg portions 12 of the tubes 10 which are at the side of the inlet stub 15 are at the highest temperature, while the leg portions 12 of the tubes 10 which are at the side of the outlet stub 16 are at a lower temperature, and the same is applicable to the fluid flowing through the tubes 10.

During the continuous cooling process of the tubes 10 and the fluid as present in the tubes 10, any microorganisms being present in the seawater tend to attach to the tubes 10, especially the portions of the tubes 10 which are at an ideal temperature for providing a suitable environment for the microorganisms to live in, the phenomenon being known as biofouling. In order to prevent this phenomenon, a suitable anti-fouling arrangement is provided, which, in the shown example, comes in the form of a plurality of lamps 20 arranged in the compartment 100 for casting anti-fouling light on the tubes 10. For example, the light may be UVC light, which is known to be effective for realizing anti-fouling.

In the shown example, the lamps 20 are tubular lamps having a generally elongated shape. The lamps 20 are arranged in a three-dimensional pattern intersecting the pattern of various tubes 10. In other words, the lamps 20 are arranged in the same area as the tubes 10. The lamps 20 may extend both inside and outside of the U shape of the tubes 10, as shown in FIG. 1. In fact, any positioning of the lamps 20 with respect to the tubes 10 is possible within the framework of the invention, wherein the lamps 20 may have any possible orientation with respect to the tubes 10. In any case, it is practical to have a positioning in which it is possible to irradiate all portions of all tubes 10 with ultraviolet light to a sufficient extent, such as to guarantee effective anti-fouling of the entirety of tubes 10 of the box cooler 1. In that respect, it is advantageous if the light sources 20 are spaced equally throughout and alongside the entirety of the tubes 10, but such arrangement of the light sources 20 is not essential within the framework of the invention.

In order for the lamps 20 to perform the function of casting ultraviolet light on the exterior of the tubes 10 of the box cooler 1 and to thereby prevent biofouling of the tubes 10, a supply of power to the lamps 20 is needed. On the basis of this fact, the anti-fouling system which is constituted by the lamps 20 is not very well suitable to be used during a period prior to the first real use of the ship in which the box cooler 1 and the anti-fouling system are installed, i.e. prior to the maiden voyage of the ship, starting from a water area where the ship has been kept in stock until that time, such as a water area near a shipyard where the ship was built. According to the invention, in order to prevent the tubes 10 of the box cooler 1 from fouling during the period as mentioned, additional anti-fouling measures are taken, aimed at protecting the tubes 10 against contact with water without needing a supply of power in order to be effective.

Figure 2:
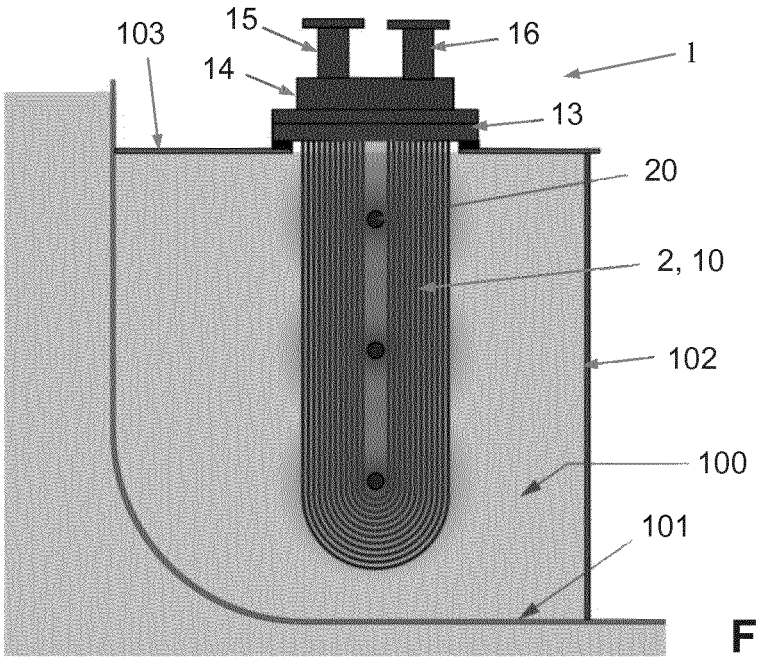
FIG. 2 diagrammatically shows the compartment of the ship, the box cooler, and a number of lamps for casting anti-fouling light over the exterior of the tubes of the box cooler.
Figure 3:
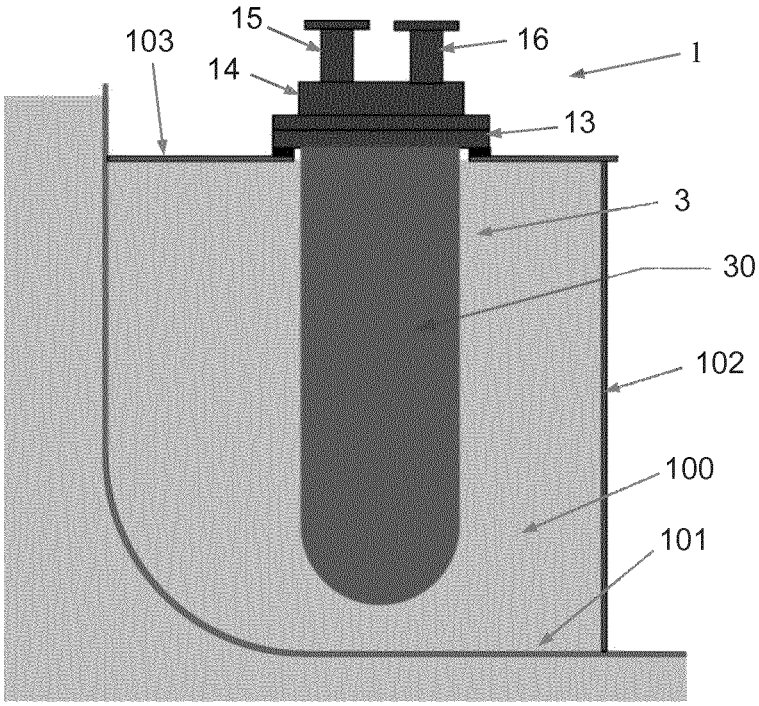
FIG. 3 diagrammatically shows the compartment of the ship, the box cooler, and the lamps as shown in FIG. 2, the entirety of the tubes of the box cooler and the lamps as present in the area of the entirety of the tubes being enwrapped in a protective foil.
Figure 4:
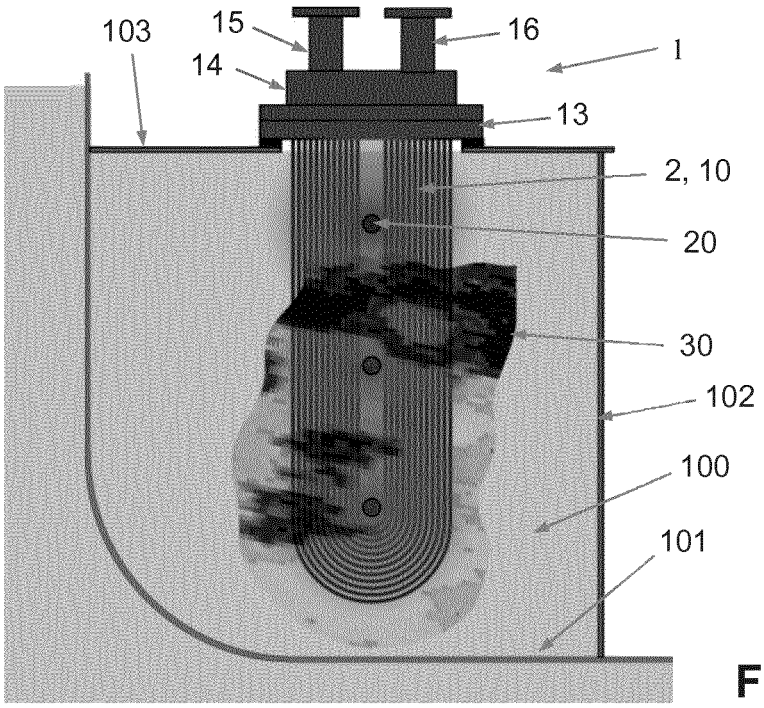
FIG. 4 illustrates disintegration of the foil as shown in FIG. 3.

FIGS. 2, 3 and 4 illustrate one possible example of an anti-fouling system which is adapted to prevent the box cooler 1 in the compartment 100 from being contacted by water as long as it is not possible/desirable to activate the anti-fouling system comprising the plurality of ultraviolet lamps 20. In the shown example, the first anti-fouling system comprises a piece of foil 30 which is wrapped around the entirety 2 of the tubes 10 of the box cooler 1 and at least a number of the lamps 20 of the anti-fouling system in a watertight fashion. In particular, the piece of foil 30 may be shaped like a sleeve which is closed at a bottom side and which is open at a top side, wherein the shape and the dimensions of the sleeve are adapted to the shape and the dimensions of the entirety 2 of the tubes 10. FIGS. 2 and 3 show the same view of the box cooler 1, the anti-fouling system, and the compartment 100, wherein FIG. 3 shows the piece of foil 30, whereas FIG. 2 does not show the piece of foil 30 and is therefore suitable to be used for understanding what is inside the piece of foil 30.

In the manufacturing process of the ship, it is practical if an assembly 3 of the entirety 2 of the tubes 10 and the piece of foil 30 is made first and is then installed in the ship, contrary to enwrapping the entirety 2 of the tubes 10 in the piece of foil 30 while already being put in place in the compartment 100 (or, as the case may be, in the compartment 100 to be). The assembly 3 which is made prior to installation in the ship may furthermore comprise at least a number of the lamps 20, but it may also be practical for the lamps 20 to be installed at the enwrapped area later, provided that this is possible, which, in the shown example, may particularly be the case if the lamps 20 to be positioned inside the U shape of the tubes 10 can be installed from the top side.

As long as the piece of foil 30 is present, it is achieved that fouling of the tubes 10 is prevented, as the piece of foil 30 constitutes a physical barrier between the tubes 10 and water in the compartment 100. However, as soon as it is desired to use the tubes 10 for cooling a fluid, it is necessary to expose the tubes 10 to the water. Hence, at that point, there is a need for at least partially removing the protective piece of foil 30. This is done in a very practical way, namely by applying the anti-fouling system having the lamps 20, and providing the piece of foil 30 with material that is degradable under the influence of ultraviolet light. In this respect, the foil 30 may be entirely made of such material, so that when the lamps 20 are activated, all of the foil 30 disintegrates under the influence of the ultraviolet light emitted by the lamps 20. The disintegration of the foil 30 is illustrated in FIG. 4. Once the foil 30 is at least partially gone, the water flowing through the compartment 100 is allowed to reach the tubes 10 of the box cooler 1, so that the box cooler 1 is allowed to perform its cooling function. Until the time that the foil 30 is removed from the tubes 10, biofouling of the tubes 10 is prevented in a passive way, namely by means of the foil 30, while after that time, bio fouling of the tubes 10 is prevented in an active way, namely by means of the lamps 20. The lamps 20 may be controlled such as to operate at maximum power or near maximum power as soon as they are activated for the first time, so that disintegration of the foil 30 takes place in a most effective way. Furthermore, one or more water sensors arranged in a space inside the piece of foil 30 may be used for activating the lamps 20 and/or issuing a warning signal in case of leakage prior to an intended first activation of the lamps 20.

It is not necessary for all of the foil 30 to disappear when it is intended to operate the box cooler 1 for the very first time. The fact is that it is possible for the foil 30 to comprise parts which are made of material that is degradable under the influence of ultraviolet light, and parts which are made of another material. In such a case, it is possible to think of a design of the foil 30 in which the first foil parts are arranged such that the latter foil parts sink to the bottom of the compartment 100 when the first foil parts disintegrate. In order to ensure fast disintegration of the first foil parts, it may be so that those parts are made such as to be relatively thin. According to another possibility existing within the framework of the invention, the piece of foil 30 comprises parts which are entirely made of material that is degradable under the influence of ultraviolet light, and parts which are made of water soluble material covered with a layer of material that is degradable under the influence of ultraviolet light, at least at the exterior side thereof, i.e. the side facing the water in the compartment 100. When the lamps 20 are switched on, the first foil parts disappear under the influence of the ultraviolet light emitted by the lamps, and the latter foil parts disappear in two steps, namely under the influence of the ultraviolet light in a first instance, and under the influence of the water in a second instance. In another embodiment, the piece of foil 30 can be entirely made of water soluble material covered with material that is degradable under the influence of ultraviolet light.

In respect of the material that is degradable under the influence of ultraviolet light, it is noted that examples of such material are known per se, and that such material may particularly comprise a polymer.

The invention is applicable to all possible types of apparatus to be exposed to water during operation, which may be used as functional units in larger devices, as is the case with the entirety 2 of tubes 10 of the box cooler 1 as described in the foregoing. In order for the anti-fouling system of the invention to be effective, it is not necessary that another anti-fouling system is arranged with the apparatus for continuing the anti-fouling function of the first anti-fouling system as soon as this has been made ineffective, although this is preferred in practical cases for obvious reasons and non-obvious reasons, where the latter reasons include the possibility of applying the latter anti-fouling system in the process of eliminating the first anti-fouling system. Having sources 20 for emitting ultraviolet light in the latter anti-fouling system and material that is degradable under the influence of ultraviolet light in the first anti-fouling system is just one of the examples existing within the framework of the invention in that respect.

Figure 5:
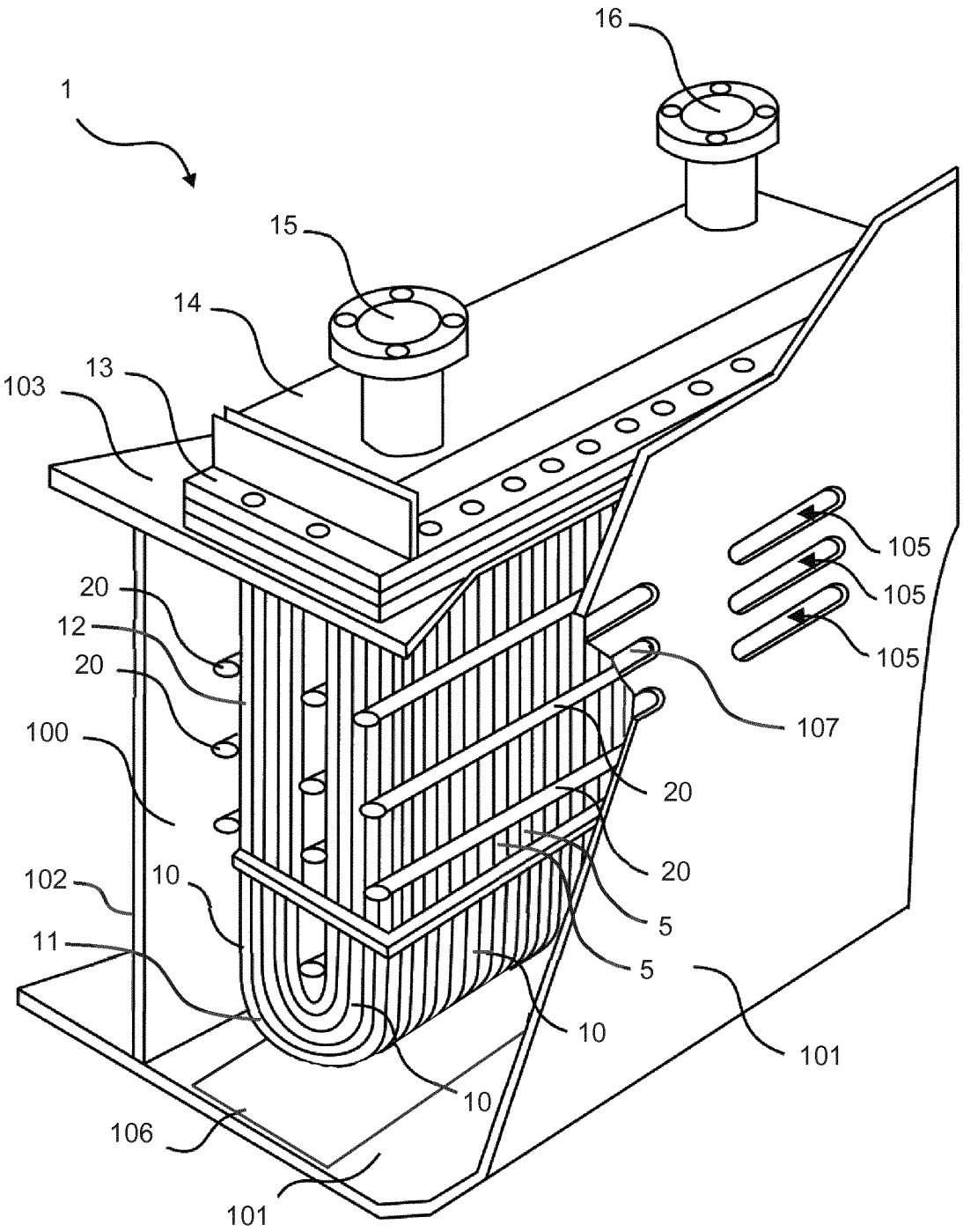
FIG. 5 illustrates an application of two pieces of degradable foil for initially closing openings of the compartment of the ship.

In another possible example of an anti-fouling system which is adapted to prevent the box cooler 1 in the compartment 100 from being contacted by water as long as it is not possible/desirable to activate the anti-fouling system comprising the plurality of ultraviolet lamps 20, the first anti-fouling system may particularly be associated with at least the entry openings 104 of the compartment 100. In particular, such anti-fouling system may comprise at least one degradable shutter element which is arranged so as to initially block the openings 104 of the compartment 100, such that it is not possible for water to enter the compartment 100 through the openings 104. FIG. 5 serves to illustrate the possibility of using at least one degradable shutter element for closing at least the entry openings 104 of the compartment 100. In the shown example, one piece 106 of degradable foil is arranged such as to cover the entry openings 104 of the compartment 100 at the inside of the compartment 100, and another piece 107 of degradable foil is arranged such as to cover the exit openings 105 of the compartment 100 at the inside of the compartment 100. All options as mentioned in the foregoing with respect to the degradable foil 30 which is associated with the tubes 10 of the box cooler 1 are equally applicable if the foil 106, 107 is associated with the openings 104, 105 of the compartment 100. In particular, it is also very practical to use the anti-fouling lamps 20 for causing disintegration of the foil 106, 107 as soon as there is a need for terminating the protective function of the foil 106, 107.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention. The phrase "a plurality of" as used in this text should be understood such as to mean "at least two".

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The term "substantially" as used in this text will be understood by a person skilled in the art as being applicable to situations in which a certain effect is intended which can be fully realized in theory but which involves practical margins for its factual implementation. Examples of such an effect include a parallel arrangement of objects and a perpendicular arrangement of objects. Where applicable, the term "substantially" may be understood such as to be an adjective which is indicative of a percentage of 90% or higher, such as 95% or higher, especially 99% or higher, even more especially 99.5% or higher, including 100%.

The term "comprise" as used in this text will be understood by a person skilled in the art as covering the term "consist of". Hence, the term "comprise" may in respect of an embodiment mean "consist of", but may in another embodiment mean "contain/include at least the defined species and optionally one or more other species".

The invention is not restricted to a context of a particular type of water such as seawater, as bio fouling may occur in other types of water as well, including river water and lake water. In fact, the term "water" as used in this text should be understood such as to cover a wide range of fluids, including mixtures containing water, water-based solutions, etc.

In case the invention is applied to a cooling apparatus such as a box cooler 1 comprising a plurality of tubes 10 and the protector arrangement comprises a piece of foil 30 to be associated with the tubes 10, the piece of foil 30 may be used to enwrap the entirety 2 of the tubes 10 and every other possible element which is present in the area of the entirety 2 of the tubes 10. Such element may be a lamp 20 for emitting ultraviolet light as is the case in the shown example, but other examples of such element are feasible as well, including a plate arranged transversely to the tubes 10, having holes for allowing the tubes 10 to pass through, and having a function in fixing the tubes 10 in an appropriate positioning. Furthermore, it is noted that within the scope of the invention, an alternative option exists according to which every tube 10 of a box cooler 1 is separately enwrapped in a piece of degradable foil instead of the entirety 2 of the tubes 10 being enwrapped.

In respect of the possible application of the invention in the context of a box cooler 1, it is noted that the invention is in no way restricted to the layout of the box cooler 1 as described in the foregoing and illustrated in the figures as an example. It is clear to a person skilled in the art that the features of the invention are not dependent on any feature of the surface to be initially protected against the fouling effect of water. Also, the application of ultraviolet light sources 20 for disintegrating the anti-fouling protector arrangement 30, 106, 107 and possibly also for realizing anti-fouling effects after the protector arrangement 30, 106, 107 has been put to a condition of allowing water to contact a surface to be initially protected, is just one of the many possibilities existing within the framework of the invention.

It is not essential for the assembly according to the invention to comprise a compartment 100, as the concept of applying a combination of a protector arrangement 30, 106, 107 comprising degradable material for preventing exposure of a surface of an object 2, 101, 102, 103 to water during a first period and allowing such exposure during a subsequent second period does not necessarily involve an arrangement of the surface in a compartment 100. In case a compartment 100 is included in the assembly according to the invention, such compartment 100 may be used for accommodating the tubes 10 of a box cooler 1 and/or one or more other objects/units, but may also be empty, i.e. does not need to contain any objects/units. For example, in case the assembly is applied in a ship, the compartment 100 may be a so-called sea chest for containing ballast water, fire extinguishing water, or drink water. In respect of the possible application of the assembly in a ship, it is noted that the invention is similarly useful in a context of other vessel types. Hence, the term "ship" as used in this text should not be understood such as to imply that the scope of the invention is restricted to one particular type of vessel as normally indicated by means of this term. In general, the invention is suitable to be used in the context of marine objects, wherein oilrigs, or other types of buildings in or next to the ocean are mentioned as being practical examples of such objects besides vessels. Furthermore, it is noted that the invention may also be applicable in the context of a domestic appliance in which water is used during operation thereof, for example, such as a coffee maker or a water disinfector, or another context which may be totally different from the context of marine objects.

In the shown embodiment of the assembly according to the invention, the compartment 100 is provided with at least one entry opening 104 for allowing water to enter the compartment 100 and at least one exit opening 105 for allowing water to exit the compartment 100. That does not alter the fact that the option of only a single opening being present, wherein the opening has a combined function of being an entry opening and an exit opening, is also covered by the invention. For the sake of completeness, it is noted that it is not essential to have at least one exit opening 105, on the basis of the fact that practical cases exist in which there is no need for emptying the compartment 100 through one or more exit openings 105 after initial filling.

In short, the invention relates to an assembly comprising an object 2, 101, 102, 103 having a surface which is intended to be exposed to water during at least a part of the lifetime thereof. In order to be capable of avoiding bio fouling of the surface in a first stage of the lifetime of the assembly, without needing to have a supply of power in order to achieve the anti-fouling effect as desired in that first stage, the assembly furthermore comprises an anti-fouling protector arrangement 30, 106, 107 which is adapted to initially prevent the surface from being contacted by water, and which comprises degradable material. Also, the assembly comprises at least one energy source 20 which is adapted to emit energy for causing the protector arrangement 30, 106, 107 to disintegrate. Such an energy source may be an energy source having a primary function in preventing bio fouling of the surface.

Examples of the surface of the object 2, 101, 102, 103 which is initially prevented by the protector arrangement 30, 106, 107 from being contacted by water include an exterior surface of a functional unit such as the entirety 2 of tubes 10 of a cooling apparatus 1, in which case the assembly may comprise a compartment 100 for accommodating the functional unit 2, and an interior surface of at least one wall 101, 102, 103 delimiting such compartment 100.

The invention claimed is:

1. An assembly comprising:

a cooling unit having a surface, wherein the cooling unit transfers heat to water via the surface, a foil, wherein the foil is comprised at least in part of degradable material, wherein the foil is arranged to enwrap the cooling unit in a watertight fashion, and at least one energy source, wherein the at least one energy source emits energy that causes the degradable material of the foil to disintegrate, thereby exposing the surface to the water.

2. The assembly according to claim 1, wherein the energy source is arranged to prevent biofouling of the surface of the cooling unit using the energy emitted by the energy source.

3. The assembly according to claim 2, wherein the energy source is operated at a first power level to cause the degradable material of the foil to disintegrate, wherein the energy source is operated at a second power level to prevent the biofouling of the surface of the object, and wherein the first power level is significantly higher than the second power level.

4. The assembly according to claim 1, wherein the foil comprises a combination of a first part and a second part, wherein the first part comprises the degradable material, and wherein the second part comprises material that remains intact when exposed to the energy emitted by the enemy source.

5. The assembly according to claim 1, further comprising a compartment, wherein the compartment is provided with at least one entry opening, and wherein the surface of the cooling unit is disposed within the compartment.

6. The assembly according to claim 5, further comprising a water sensor, wherein the water sensor is disposed within the compartment, and wherein the energy source is activated when water is detected by the water sensor.

7. The assembly according to claim 1, wherein the energy emitted by the energy source comprises ultraviolet light.

8. A vessel, comprising:

an assembly according to claim 1, an engine, wherein the engine is arranged to drive the vessel; and an engine cooling system, wherein the engine cooling system comprises the cooling unit, wherein the cooling unit is arranged to cool a cooling fluid of the engine cooling system, wherein the cooling unit comprises a plurality of tubes, wherein the plurality of tubes is arranged to contain and transport the cooling fluid, and wherein the vessel comprises a compartment for accommodating the cooling unit.

9. The assembly according to claim 1, wherein the foil comprises a first part and a second part, wherein the first part comprises the degradable material, wherein the second part comprises water soluble material, and wherein the second part is covered by the first part.

10. A vessel comprising:

an engine;

an engine cooling system, wherein the engine cooling system comprises a cooling unit, and wherein the cooling unit transfers heat from the engine to water via a surface of the cooling unit;

a protective material, and wherein at least a portion of the protective material comprises degradable material, and wherein the protective material isolates the surface of the cooling unit from the water;

an energy source, wherein the energy source emits energy that disintegrates the degradable material, thereby exposing the surface of the cooling unit to the water.

11. The vessel of claim 10, comprising a compartment, wherein the cooling unit is situated in the compartment, and wherein the compartment includes openings that enable the water to enter the compartment.

12. The vessel of claim 10, wherein the energy emitted by the energy source inhibits biofouling of the cooling unit.

13. The vessel of claim 12, wherein the energy source emits the energy at a first energy level that disintegrates the degradable material, wherein the energy source emits the energy at a second energy level that inhibits the biofouling of the cooling unit, and wherein the first energy level is significantly higher than the second energy level.

14. The vessel of claim 10, wherein the protective material comprises the degradable material and an other material, wherein the other material is water-soluble, and wherein the degradable material isolates the other material from the water.

15. The vessel of claim 10, comprising a water sensor, wherein the energy sensor emits the energy when the water sensor detects the water.

16. A vessel comprising:

a compartment, wherein the compartment includes openings that allow water to enter the compartment;

an object, wherein the object is situated in the compartment, and wherein the object has a surface, a protective material, and wherein at least a part of the protective material comprises degradable material, and wherein the protective material isolates the surface of the object from the water;

an energy source, wherein the energy source emits energy that disintegrates the degradable material, thereby exposing the surface of the object to the water.

17. The vessel of claim 16, wherein the energy of the energy source inhibits biofouling of the object.

* * * * *